United States Patent [19]

Warin

[11] Patent Number: 4,625,621

[45] Date of Patent: Dec. 2, 1986

[54] COMPACT FOLDABLE GUN

[75] Inventor: Francis J. Warin, Oak Harbor, Ohio

[73] Assignee: ARES, Inc., Port Clinton, Ohio

[21] Appl. No.: 596,048

[22] Filed: Apr. 2, 1984

[51] Int. Cl.[4] ..... F41C 9/02

[52] U.S. Cl. ..... 89/197; 42/1.09; 42/71.01; 89/1.4; 89/33.1; 89/132; 89/198

[58] Field of Search ..... 89/33.1, 196, 197, 199; 42/1 J, 6, , 7, 71 R, 72, 73; D22/1, 6

[56] References Cited

U.S. PATENT DOCUMENTS

| | | | |
|---|---|---|---|
| 521,202 | 6/1894 | Burgess | 42/72 |
| 524,800 | 8/1894 | Burgess | 42/72 |
| 652,583 | 6/1900 | Baird | 42/71 R |
| 680,243 | 8/1901 | Gioda | 42/7 |
| 2,348,790 | 5/1944 | Kiraly et al. | 89/199 |
| 2,424,944 | 7/1947 | Patchett | 42/72 |
| 3,267,600 | 8/1966 | Ryan | 42/1 J |
| 3,341,964 | 9/1967 | Ryan et al. | 42/1 J |
| 3,618,249 | 11/1971 | Grandy | 42/73 |
| 3,782,019 | 1/1974 | Ventorini | 42/72 |
| 3,798,819 | 3/1984 | Hillberg | 42/72 |

FOREIGN PATENT DOCUMENTS

| | | | |
|---|---|---|---|
| 324634 | 9/1920 | Fed. Rep. of Germany | 42/7 |
| 3222001 | 12/1983 | Fed. Rep. of Germany | 42/1 J |
| 465174 | 8/1951 | Italy | 89/33.1 |

*Primary Examiner*—Stephen C. Bentley
*Attorney, Agent, or Firm*—Allan R. Fowler

[57] ABSTRACT

A foldable gun, useful in mob control and police undercover work because of small size and unassuming appearance when it is in folded configuration, includes a magazine housing and stock pivotally mounted to a receiver assembly in a manner in which the magazine housing may be pivoted to a parallel position adjacent a receiver assembly underside while containing a magazine. Pivotal mounting of the stock enables the stock to fold to an underside of the receiver assembly. A U-shaped configuration of the stock enables it to both contain and conceal the magazine housing and magazine when the gun is in the folded configuration. In this manner, an extremely compact folded gun is achieved, and further, the gun, when folded, does not resemble a weapon.

10 Claims, 5 Drawing Figures

COMPACT FOLDABLE GUN

The present invention relates to a foldable gun, and more particularly to a foldable machine gun which, in a folded configuration, does not resemble or suggest an appearance of being any type of small arms weapon.

In both mob control and police undercover work, the presence of a small arms weapon, particularly a machine gun, may not be desirable for a number of reasons. Psychologically, the appearance of a machine gun to a crowd may increase tensions between the crowd and the uniformed officers attempting to control the actions of the crowds. However, it should be obvious that a machine gun is a useful weapon for disbursing the crowd, as by firing the machine gun over the heads of people in the crowd.

In these situations it is desirable for the crowd control peace officers to either carry weapons concealed on their person, or in their hands, and this weapon should not resemble a weapon, or more particularly, a machine gun. It is also necessary, in order to be useful, that such a concealable gun, when in a folded condition, be quickly and easily unfolded or arranged in an operative configuration so as to be immediately operable by the peace officers.

Similarly, if the concealable, and hence, compact, folding machine gun is to be carried in the clothing of an undercover police officer or agent, an obvious requirement for usefulness is the rapid deployment of the weapon for use when the situation necessitates.

Although many foldable weapons have been developed in the past,, that majority of these weapons were developed for reasons such as reducing the overall size of the weapon for storage and transportation. In most of these cases, the folded gun remains distinguishable as a folded gun and hence has no advantage in police undercover work because they are so recognizable.

In fact, the majority of these weapons are not foldable or collapsible, to a size which would permit their concealment on the body of an undercover agent. Furthermore, the majority of these weapons are not foldable while containing a magazine holding ammunition. It should be apparent that, if such a weapon is to be easily deployed, it should, in its folded configuration, contain sufficient ammunition rounds in order to be useful for its intended purpose after it is rapidly unfolded for use.

It is also very desirable that the weapon be unfoldable with a minimum of effort. That is, assembly of the pieces together, such as the screwing one part into another and thereafter latching the weapon together with a final insertion of a magazine, in order to put the weapon in a prepared or operational state is an undesirable and time-consuming requirement. The weapon loses its usefulness in both undercover work and in crowd suppression activities when it takes a few minutes to assemble the weapon in order to use it.

The present invention is directed to a compact foldable gun, preferably a machine gun, which, in its folded configuration, bears no resemblance to any type of firearm. Further, the compact foldable gun of the present invention is easily carried in the inside jacket pocket of a typical man's suit and, therefore, is completely concealed on the body of the carrier.

Additionally, the folding gun of the present invention may carry a significant number of ammunition rounds suitable for use in a machine gun and contains all these rounds when the foldable machine gun is in a folded configuration for carrying on the person of the user.

Finally, only one simple motion by the user of the gun is necessary to convert the folded machine gun to its unfolded, or operational position, with the magazine in place and ready to fire ammunition.

SUMMARY OF THE INVENTION

A compact foldable gun, in accordance with the present invention, includes a receiver assembly and a magazine housing means pivotally mounted to the receiver assembly on an underside thereof for supporting a magazine and operative for aligning the magazine with the receiver assembly for feeding ammunition in the receiver assembly when the foldable gun is unfolded into an open and operative configuration for the firing of ammunition.

The magazine housing is further operative for supporting the magazine in a position generally parallel and adjacent to a receiver assembly underside when the foldable gun is in the folded configuration for storing and carrying.

Stock means are provided, which is pivotally mounted to the receiver assembly for providing a shoulder support for the receiver assembly when the stock means is in an unfolded position and the foldable gun is in an operative configuration for firing ammunition. The stock means is further operative for containing the magazine housing and magazine when the foldable gun is in a folded configuration with the stock means pivoted to a position generally parallel with the receiver assembly and adjacent to the receiver assembly underside. In this manner, an extremely compact folded gun is achieved because the stock means, when folded, contains the magazine housing and the magazine.

More particularly, in accordance with the present invention, the foldable gun receiver assembly includes pivotally mounted trigger means, a bolt and a sear, with the sear and pivotally mounted trigger means being disposed in an operative relationship for locking and unlocking the bolt. To accommodate folding of the gun, the pivotally mounted trigger means is further operative for rotating inwardly toward the receiver assembly during folding of the foldable gun. In the case of a foldable machine gun, the sear is operational only to lock the bolt to prevent sequential firing of the ammunition.

To enhance the compactness of the gun, the receiver assembly includes a barrel disposed within the bolt and the bolt, upon recoil, slides along an outside of the barrel, with the rear portion of the bolt extending into the shock means upon recoil. The stock means includes buffer means for stopping the recoil movement of the bolt.

Buttstock means are provided as part of the stock means, with the buttstock means being operative for engaging an operator's shoulder when the foldable machine gun is in an operative configuration. The buttstock means is also sized for covering a bottom end of the magazine and the front end of the receiver assembly when the foldable machine gun is in a folded configuration.

In order to lock the foldable gun in a folded configuration, the receiver assembly includes a bolt having a portion thereof extending outwardly from the front end of the receiver assembly when the foldable gun is in a folded configuration and the buttstock means includes means defining an opening therein, with this opening being configured for engaging the portion of the bolt extending outwardly from the front end of the receiver assembly in order to lock the foldable gun in the folded configuration.

Additionally, the receiver assembly includes bolt insert means for supporting a firing pin, with the bolt insert means being removably fixed to the bolt at the rear end thereof for movement with the bolt during recoil. The firing pin is disposed in a position for engaging ammunition disposed in a chamber of the receiver assembly upon counter recoil movement by the bolt.

An additional feature of the present invention is that the barrel of the foldable gun may be examined while the foldable gun is in a folded configuration and, if necessary, a cleaning rod may be inserted therethrough. To accomplish this, the bolt insert means is removable from the receiver assembly when the foldable gun is in a folded configuration and the means defining an opening in the buttstock means further defines an opening larger than an inside barrel diameter. The opening is disposed in the buttstock to enable the cleaning rod to be passed through the barrel when the foldable gun is in the folded configuration, with the bolt insert means removed from the bolt.

A cocking grip means is slidably disposed on a topside of the receiver assembly in a position for grasping by an operator. The cocking grip means is disposed for engaging the barrel and operative for moving the bolt rearwardly to a cocked position wherein the bolt is engaged by the sear and simultaneously moving the portion of the bolt extending outwardly from the front end of the receiver from the opening defined in the buttstock in order to unlock the foldable gun from the folded configuration and enable movement of the stock means and magazine housing to place the foldable gun in an open and operative position.

The trigger means and the magazine housing means are spring biased for forcing the trigger means and the magazine housing means into an operational position as the stock means is rotated into an unfolded position to cause the foldable gun to unfold into an open and operative configuration for firing the ammunition. Hence, a single movement of the cocking grip means rearwardly to cock the weapon causes an unlocking of the folded gun and subsequent automatic movement of the trigger means and the magazine housing means along with the stock means to operational positions.

BRIEF DESCRIPTION OF THE DRAWINGS

The advantages and features of the present invention will be better understood by the following description and drawings in which.

DETAILED DESCRIPTION

Figure 1:
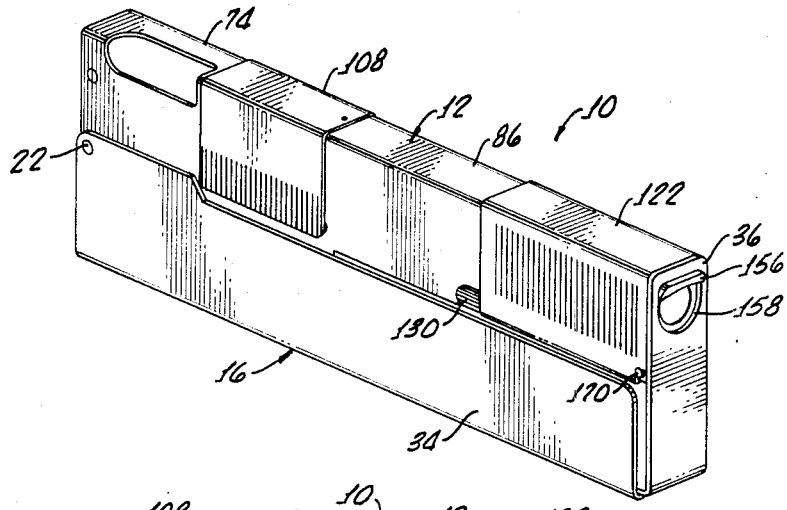
FIG. 1 is a perspective view of a compact foldable gun in accordance with the present invention, generally showing the receiver assembly and the stock means along with the cocking grip.
Figure 2:
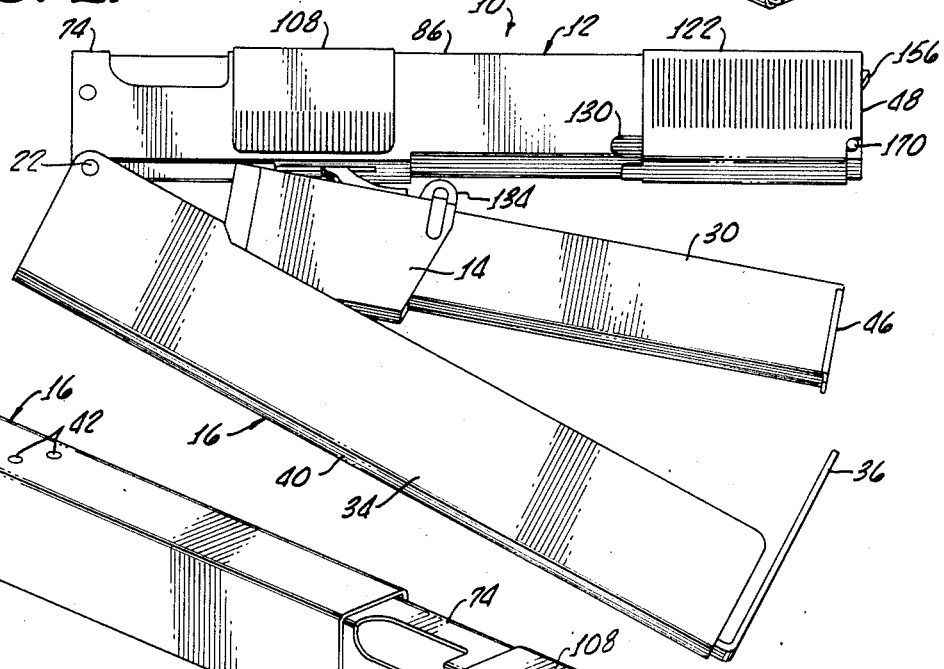
FIG. 2 is a perspective view of the compact foldable machine gun in accordance with the present invention, showing the gun as it unfolds and more particularly, showing the magazine housing means and the magazine as they emerge from the stock means and the trigger means as it begins to move from the magazine housing means.
Figure 3:
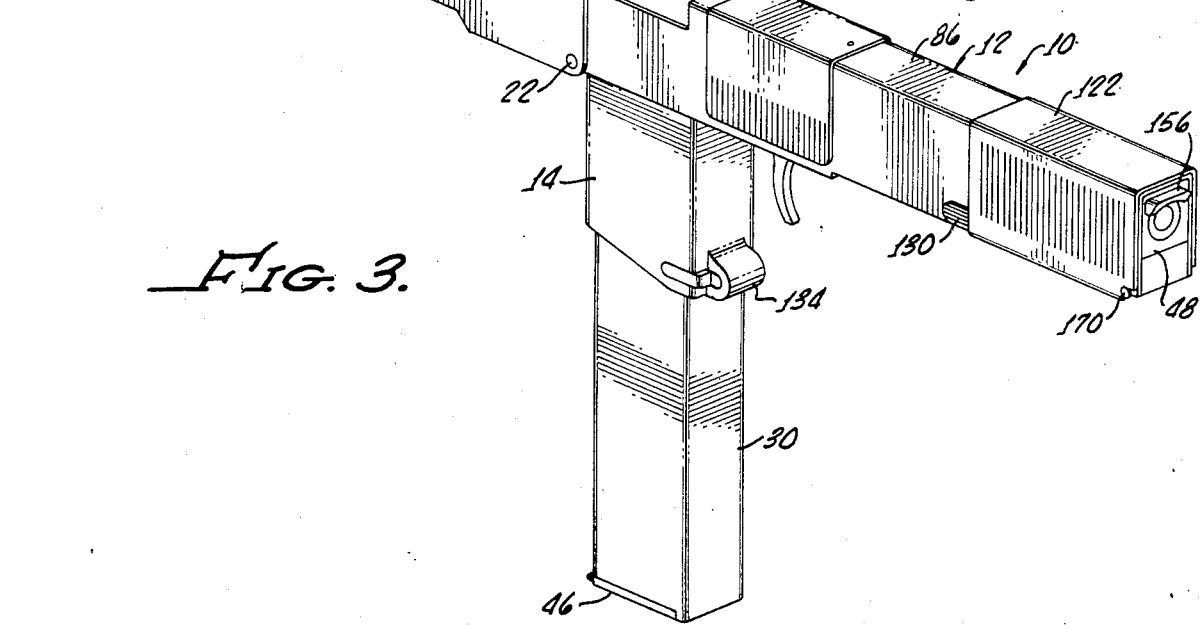
FIG. 3 is a perspective view of the compact folding gun with the receiver assembly, magazine housing means, magazine, trigger means and stock means in operative positions placing the gun in an operative configuration.

Turning now to FIGS. 1, 2 and 3, there is shown a compact foldable gun 10, in accordance with the present invention, generally showing a receiver assembly 12, a magazine housing 14 and a stock 16 pivotally mounted to the receiver assembly by means of a pin 22.

Figure 4:
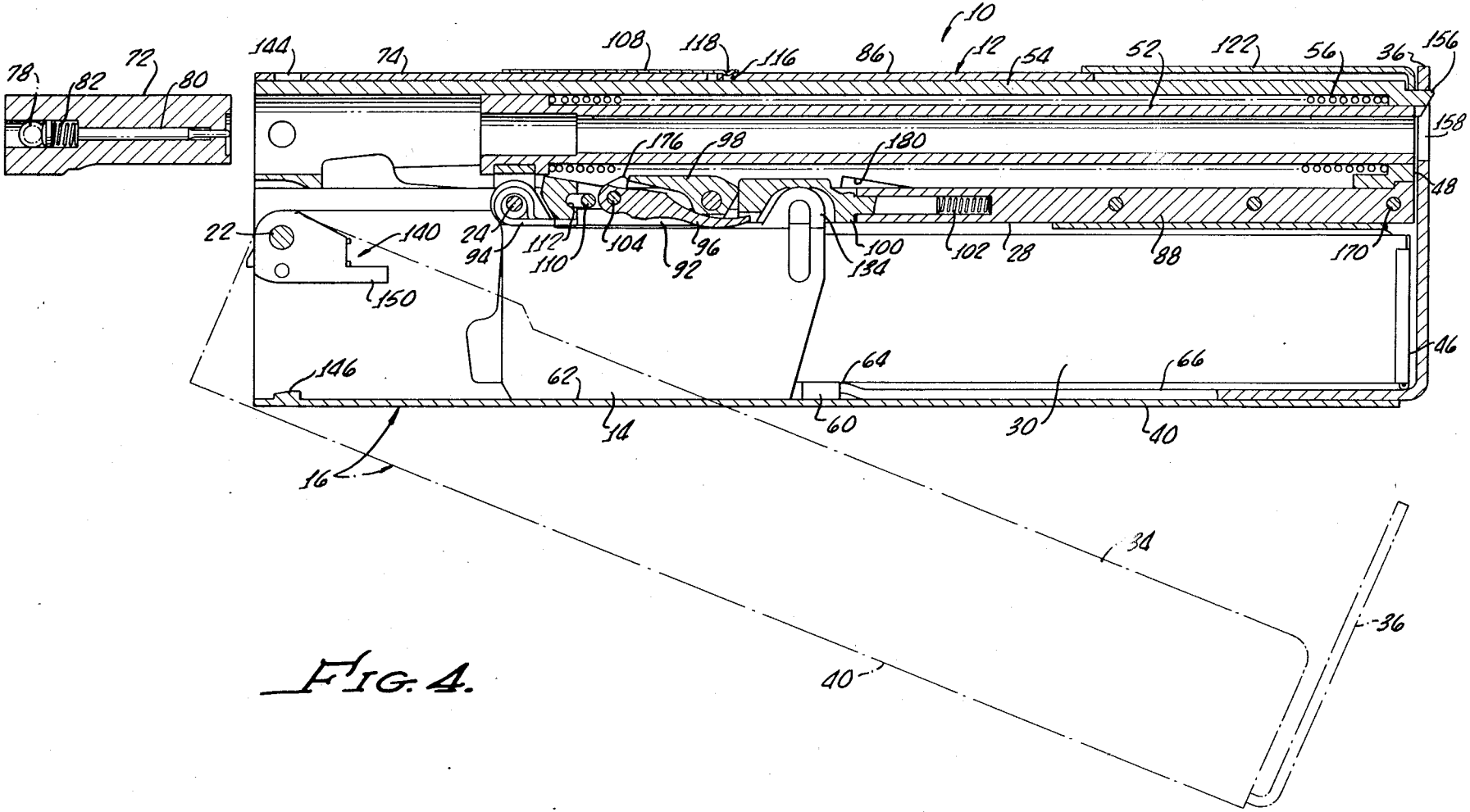
FIG. 4 is a cross-section of the compact foldable gun in its folded configuration, showing a bolt insert means removed from the gun, enabling the barrel of the gun to be inspected and cleaned.

More particularly, as shown in FIG. 4, which is an approximately full size cross-section of the foldable gun 10, the magazine housing 14 is pivotally mounted to the receiver assembly 12 by means of a pin 24 on an underside 28 thereof and provides means for supporting a magazine 30 and is operative for aligning the magazine 30 with the receiver assembly 12 for feeding ammunition (not shown) into the receiver assembly when the foldable gun 10 is unfolded to an open and operative position, (see FIG. 3), and for supporting the magazine in a position generally parallel to and adjacent the receiver underside 12 when the foldable gun is in a folded configuration, (see FIG. 1), for storage and carrying.

It is evident from FIG. 4, which is an approximate full size, cross section of the foldable gun 10, in accordance with the present invention, that it may be easily carried upon the person of a user (not shown) in a jacket pocket or the like. It is also evident from FIG. 1 that the foldable gun 10, when in a folded configuration, does not resemble a machine gun, and certainly would not be suspected to be one because of its overall size and shape.

The stock 16 includes a generally U-shaped portion 34 and a buttstock 36 attached to a top side 40 of the U-shaped stock portion 34 by means of rivets 42 (see FIG. 5) or the like.

The generally U-shaped stock portion 34 enables the stock to provide means for containing the magazine housing 14 and magazine 30 when the foldable gun 10 is in a folded configuration with the stock 16 pivoted to a position generally parallel with the receiver assembly 12 and adjacent the receiver assembly underside 28 as is shown in FIG. 1.

Shoulder support is provided by the stock by means of the buttstock 36 when the stock 16 is in an unfolded position and the foldable gun 10 is in an operative configuration for firing ammunition as is shown in FIG. 3.

As will be described hereinafter in greater detail the buttstock further provides means for covering a bottom end 46 of the magazine 30 and a front end 48 of the receiver assembly 12 when the foldable gun 10 is in a folded configuration.

Figure 5:
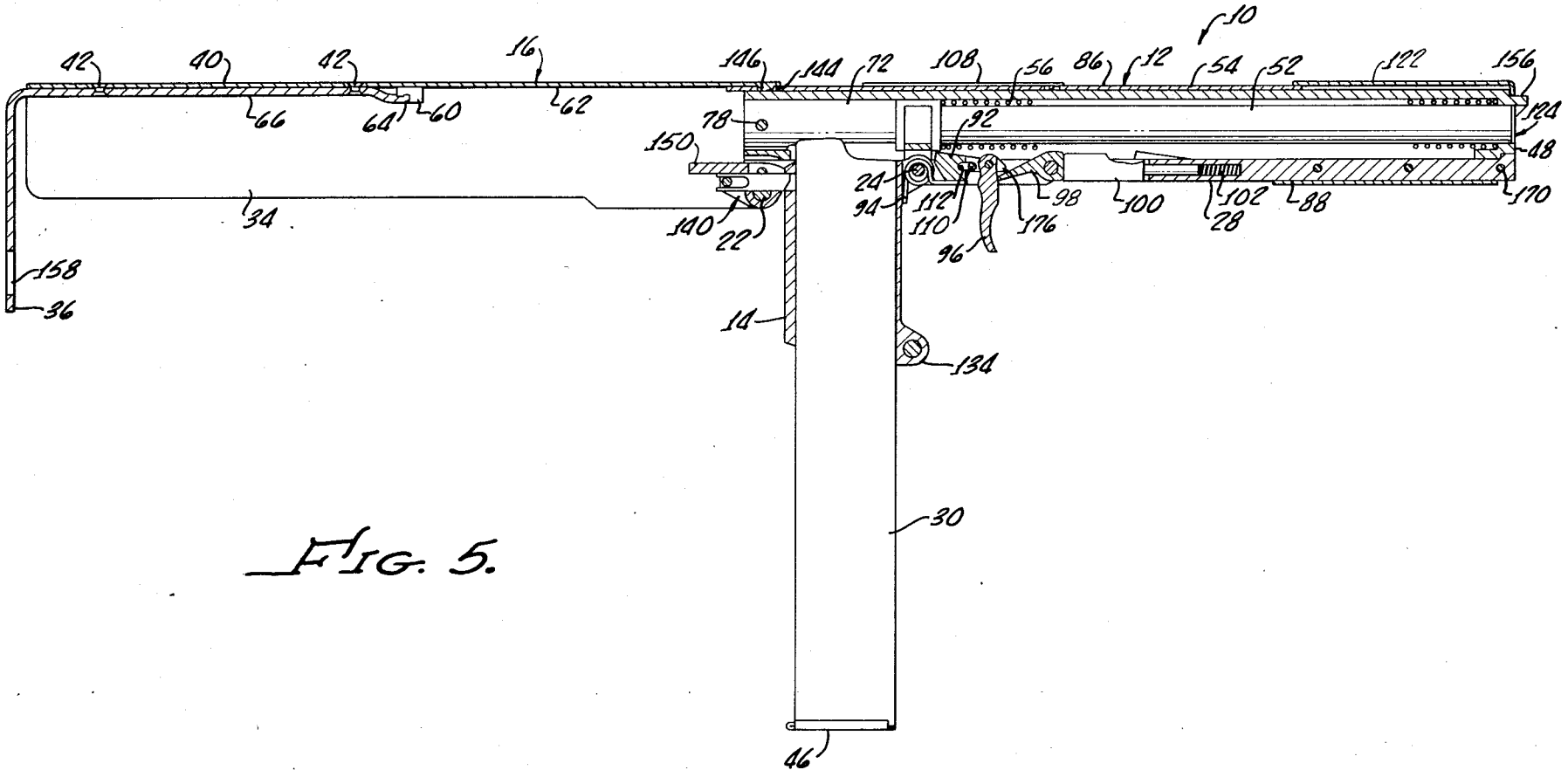
FIG. 5 is a cross-section of the compact foldable gun in accordance with the present invention showing the gun in an open an operative configuration.

As most clearly seen in FIGS. 4 and 5, the receiver assembly 12 includes a barrel 52, which is surrounded by a bolt 54 and a bolt recoil spring 56. The barrel 52, bolt 54 and bolt spring 56 may be mounted on the receiver in a conventional manner, so that upon recoil the bolt 54 moves rearwardly sliding along an outside of the barrel 52 and into the stock U-shaped portion 34.

A stop or buffer 60 disposed on an underside 62 the top 40 of the stock U-shaped portion 34 at an end 64 of a buttstock angle portion 66 provides a limit for bolt 54 movement.

Aligned with the barrel 52, a bolt insert 72 is disposed at a rear end 74 thereof and retained within the bolt 54 by means of a pin 78, which also provides means for holding a firing pin 80 and associated spring 82 within the bolt insert 72.

As shown in FIG. 4, removal of the retaining pin 78 enables the bolt insert 72 along with the firing pin 80 and spring 82 to be removed from the bolt to enable field cleaning and inspection while the foldable gun 10 is in its folded configuration.

Surrounding the bolt 54 is a stamping 86 to which is attached a bottom plate 88 for housing the sear 92, sear spring 94, trigger 96, trigger latch 98, detent 100 and spring 102, the trigger 96 being pin 104 mounted to the bottom plate 88.

Slidably mounted on the exterior of the stamping 86 is a safety grip 108 interconnected with a safety bar 110 to enable movement of the safety bar into a notch 112 to prevent unsearing of the belt when the trigger 96 is pulled. A recess, or opening 116 in the stamping 86 enables a formed portion of the safety grip 118 to project thereinto for locking the safety in an off position during firing.

A cocking grip 122 is slidably mounted at a front end 124 of the receiver assembly 12 and engages the bolt 54 to enable manual movement thereof in a rearward direction, in order to compress the bolt spring 56 and sear the bolt to place the gun in a cocked position ready for firing. Rearward movement of the cocking grip 122 also unlocks the foldable gun 10 from its folded configuration as will be hereinafter described in greater detail.

A spring mounted button 130 (FIG. 1) is provided for holding the cocking grip at its forward position on the receiver assembly 12 to prevent accidental unlocking of the foldable gun 10 from its folded configuration. Depressing the button 130 enables slidable movement of the cocking grip 122.

The magazine housing 14, which also provides a grip for the foldable gun 10, is sized for supporting a standard MP40 magazine, which may be shortened to a capacity of 26 or 28 rounds to fit inside the stock 16 when the foldable gun 10 is in its folded configuration. It is to be appreciated that a full size MP40 magazine (holding 32 rounds) may be used when the folded gun is in an open configuration, but this prevents the complete folding of the foldable gun.

A magazine catch 134 is provided for holding the magazine within the magazine housing while the magazine housing aligns unfolded to an open and operative configuration for firing ammunition (not shown). The magazine housing 14 is pivotally mounted to the receiver assembly 12 by means of the pin 24 and is held in an open position for aligning ammunition with the receiver assembly 10 by a lock 140.

It should be appreciated that any number of gun configurations, including many suitable trigger linkages and sear arrangements may be utilized within the spirit of the present invention, the specific embodiment shown in the accomanying drawings being exemplary for use in describing the features of the present invention.

Means for locking the stock 16 in an operative position includes an opening 144 in the stamping 86 which is sized for receiving a protrusion 146 on the U-shaped portion inside 62. When the stock is locked open the protrusion 146 sits into the opening 144 to provide a stabile and rigid coupling between the stock 16 and the receiver assembly 12 for firing of the gun 10.

Additional components of the foldable gun 10 will be hereinafter identified with the following description of the manner in which the foldable gun 10 is folded and unfolded.

In order to fold the gun 10 from its operative configuration as shown in FIG. 5, lock lever 150 is depressed in order to force the lock 140 out of engagement with the magazine housing 14, which enables the magazine housing 16 along with the magazine to be rotated forwardly around the pin 24 and against the spring 94. It should be appreciated that if the bolt 54 is an open, seared position, depressing of the lever 150, would not be possible. This safety feature prevents accidental collapse or folding of the gun 10 while the bolt is cocked.

After the magazine housing has been fully rotated and lies approximately parallel to an adjacent receiver assembly underside 28, the stock 16 is lifted upwardly in order to disengage the protrusion 146 from the opening 144 and thereby unlock the stock from the receiver assemby 12. At this time, the stock may be rotated to a position generally parallel with the receiver assembly and adjacent the receiver assembly underside 28, while at the same time allowing the magazine housing 14, as well as the magazine, to enter into and be concealed by the U-shaped stock portion 34.

The foldable gun 10 is locked in its folded position as shown in FIG. 4 by means of a bolt portion 156 extending outwardly from the front 124 of the receiver assembly 12 and an opening 158 in the buttstock 36 (most clearly shown in FIG. 3) which is configured for engaging the bolt portion 156 upon closing of the buttstock 36 over the receiver assembly front end 124.

As the magazine housing 14 is rotated to a closed position, it engages the trigger 96, thereby rotating it about the pin 104 and into the underside 28 of the receiver assembly 12. It should be appreciated that the buttstock 36 is preferably sized for covering, or concealing, a bottom end of the receiver, as well as the front end 124 of the receiver assembly 12.

To open or unfold the foldable machine gun 10 from the configuration shown in FIG. 1 to the configuration shown in FIG. 3, the button 130 is first depressed, which enables the cocking grip 122 to be drawn back slightly to move the bolt 54 along with the bolt portion 156 from the opening 158 in the buttstock 36.

While the gun is held in an upright normal position, gravity causes the stock to swing away from the receiver assembly 12, and it may be thereafter rotated to an extended position lifting it slightly to enable the protrusion 146 to again engage the opening 144. As this occurs, the spring 94 rotates the magazine housing 14, along with the magazine, into its locked position along with the force of gravity. Similarly, the trigger 96 is rotated about the pin 104 to an operational position, which is maintained by the trigger latch 98.

At this time the cocking grip may be moved rearwardly in order to lock, or sear, the bolt and compress the bolt spring 56. After the bolt is seared, the cocking grip 122 is moved forwardly until the spring loaded button snaps outwardly to lock the cocking grip 122 between the button 130 and a pin 170.

To fire the weapon, the trigger 96 is moved rearwardly, causing a cam 176 machined on both sides of the trigger 96 to force the sear 92 out of engagement with the bolt 54. The bolt spring 56 drives the bolt 54 forwardly, which engages a cartridge (not shown) out of the magazine and into the chamber of the barrel 52 in a conventional manner. Thereafter, as the bolt closes on the cartridge, the firing pin 80 engages a primer disposed in the cartridge and fires the cartridge. The bolt 54, thereafter, is forced rearwardly by the force of the explosion in a standard blowback fashion and continues rearwardly until it strikes the buffer 60. This action continues until the trigger is released, allowing the sear 92 to again engage detent 180 in the bolt 54.

Field maintenance of the weapon is easily accomplished by pushing the bolt insert retaining pin 78 out of position and thereafter removing the bolt insert 72. The opening 158 of the buttstock 36 is larger than the inside barrel diameter and disposed in the buttstock to enable a cleaning rod to be passed through the barrel when the foldable gun 10 is in a folded configuration with the bolt insert 72 removed therefrom.

Although there has been described hereinabove a particular arrangement of a foldable gun, in accordance with the present invention, for the purpose of illustrating the manner in which the invention may be used to advantage, it should be appreciated that the invention is not limited thereto. Accordingly, any and all modifications, variations, or equivalent arrangements, which may occur to those skilled in the art, should be considered to be within the scope of the invention as defined in the appended claims.

What is claimed is:

1. A compact foldable gun comprising:

a receiver assembly;

magazine housing means pivotally mounted to the receiver assembly on an underside thereof for supporting a magazine with the receiver assembly for feeding ammunition into the receiver assembly when the foldable gun is unfolded to an open and operative configuration for firing the ammunition, and for supporting the magazine in a position generally parallel to and adjacent a receiver assembly under side when the foldable gun is in a folded configuration for storage and carrying;

stock means pivotally mounted to the receiver assembly for providing a shoulder support for the receiver assembly when the stock means is in an unfolded position and the foldable gun is in an operative configuration for firing ammunition, said stock means being further operative for containing the magazine housing and magazine when the foldable fun is in a folded configuration with the stock means pivoted to a position generally parallel with the receiver assembly and adjacent the receiver assembly underside;

said receiver assembly including pivotally mounted trigger means, a bolt and a sear, said sear and pivotally mounted trigger means being disposed in an operative relationship for locking and unlocking the bolt, said pivotally mounted trigger means being further operative for rotating inwardly toward the receiver assembly during folding of the foldable gun; and, said receiver assembly including a barrel disposed within the bolt and the bolt, upon recoil, slides along an outside of the barrel with a rear portion of the bolt extending into the stock means upon recoil.

2. The foldable gun of claim 1 wherein the stock means includes buffer means for stopping recoil movement of the bolt.

3. A compact foldable gun comprising:

a receiver assembly;

magazine housing means pivotally mounted to the receiver assembly on an underside thereof for supporting a magazine and operative for aligning the magazine with the receiver assembly for feeding ammunition into the receiver assembly when the foldable gun is unfolded to an open and operative configuration for firing the ammunition, and for supporting the magazine in a position generally parallel to and adjacent a receiver assembly underside when the foldable gun is in a folded configuration for storage and carrying;

stock means pivotally mounted to the receiver assembly for providing a shoulder support for the receiver assembly when the stock means is in an unfolded position and the foldable gun is in an operative configuration for firing ammunition, said stock means being further operative for containing the magazine housing and magazine when the foldable gun is in a folded configuration with the stock means pivoted to a position generally parallel with the receiver assembly and adjacent the receiver assembly underside;

said stock means including buttstock means, said buttstock means being operative for engaging an operator shoulder when the foldable gun is in an operative configuration, said buttstock means being sized for covering a bottom end of the magazine and a front end of the receiver assembly when the foldable gun is in a folded configuration; and, said receiver assembly including a bolt having a portion thereof extending outwardly from the front end of the receiver assembly when the foldable gun is in a folded configuration, and the buttstock means including means defining an opening therein, said opening being configured for engaging the portion of the bolt extending outwardly from the front end of the receiver assembly in order to lock the foldable gun in the folded configuration.

4. The foldable gun, in accordance with claim 3 wherein the receiver assembly includes bolt insert means for supporting a firing pin, said bolt insert means being removably fixed to the bolt at a rear end thereof for movement with the bolt during recoil, said firing pin being disposed in a position for engaging ammunition disposed in a chamber of the receiver assembly upon counterrecoil movement by the bolt.

5. The foldable gun, in accordance with claim 4 wherein the bolt insert means is removable from the receiver assembly when the foldable gun is in a folded configuration and the means defining an opening in the buttstock means further defines the opening larger than the inside barrel diameter and said opening is disposed in the buttstock to enable a cleaning rod to be passed through the barrel when the foldable gun is in a folded configuration with the bolt insert means removed from the bolt.

6. The foldable gun of claim 5 wherein the receiver assembly further includes cocking grip means slidably disposed on a top side of the receiver assembly in a position for grasping by an operator, said cocking grip means being disposed for engaging the barrel and operative for moving the bolt rearwardly to a cocked position wherein the bolt is engaged by the sear, and simultaneously moving the portion of the bolt extending outwardly from the front end of the receiver from the opening defined in the buttstock in order to unlock the foldable gun from the folded configuration and enable movement of the stock means and magazine housing to place the foldable gun in an open and operative configuration.

7. The foldable gun of claim 6 wherein the trigger means and magazine housing means are spring biased for forcing the trigger means and the magazine housing means into operational positions as the stock means is rotated into an unfolded position to cause the foldable gun to unfold into an open and operative configuration for firing the ammunition.

8. A compact foldable gun comprising:

a receiver assembly including pivotally mounted trigger means, a bolt and sear, said sear and pivotally mounted trigger means being disposed in an operative relationship for locking and unlocking the bolt, said pivotally mounted trigger means being further operative for rotating inwardly toward the receiver assembly during folding of the foldable gun;

magazine housing means pivotally mounted to the receiver assembly on an underside thereof for supporting a magazine and operative for aligning the magazine with the receiver assembly for feeding ammunition into the receiver assembly when the foldable gun is unfolded to an open and operative configuration for firing the ammunition, and for supporting the magazine in a position generally parallel to and adjacent a receiver assembly underside when the foldable gun is in a folded configuration for storage and carrying;

stock means pivotally mounted to the receiver assembly for providing a shoulder support for the receiver assembly when the stock means is in an unfolded position and the foldable gun is in an operative configuration for firing ammunition, said stock means being further operative for containing the magazine housing and magazine when the foldable gun is in a folded configuration with the stock means pivoted to a position generally parallel with the receiver assembly and adjacent the receiver assembly underside; and, said receiver assembly including a barrel disposed within the bolt and the bolt, upon recoil, slides along an outside of the barrel with a rear portion of the bolt extending into the stock means upon recoil.

9. A compact foldable machine gun comprising:

a receiver assembly including pivotally mounted trigger means, a bolt and a sear, said sear and pivotally mounted trigger means being disposed in an operative relationship for locking and unlocking the bolt, said pivotally mounted trigger means being further operative for rotating inwardly toward the receiver assembly during folding of the foldable gun, said receiver assembly further including a barrel disposed within the bolt and the bolt is adapted, upon recoil, for sliding along an outside of the barrel with a rear portion of the bolt extending into the stock means upon recoil;

magazine housing means pivotally mounted to the receiver assembly on an underside thereof for supporting a magazine and operative for aligning the magazine with the receiver assembly for feeding ammunition into the receiver assembly when the foldable gun is unfolded to an open and operative configuration for firing the ammunition, and for supporting the magazine in a position generally parallel to and adjacent a receiver assembly underside when the foldable gun is in a folded configuration for storage and carrying; and, stock means pivotally mounted to the receiver assembly for providing a shoulder support for the receiver assembly when the stock means is in an unfolded position and the foldable gun is in an operative configuration for firing ammunition, said stock means being further operative for containing the magazine housing and magazine when the foldable gun is in a folded configuration with the stock means pivoted to a position generally parallel with the receiver assembly and adjacent the receiver assembly underside, said stock means including buffer means for stopping recoil movement of the bolt.

10. A compact foldable machine gun comprising:

a receiver assembly including pivotally mounted trigger means, a bolt and a sear, said sear and pivotally mounted trigger means being disposed in an operative relationship for locking and unlocking the bolt, said pivotally mounted trigger means being further operative for rotating inwardly toward the receiver assembly during folding of the foldable machine gun, said trigger means and magazine housing means being spring biased for forcing the trigger means and the magazine housing means into operational positions as the stock means is rotated into an unfolded position to cause the foldable gun to unfold into an open and operative configuration for firing the ammunition, said receiver assembly further including a barrel disposed within the bolt and the bolt is adapted, upon recoil, for sliding along on outside of the barrel with a rear portion of the bolt extending into the stock means upon recoil;

magazine housing means pivotally mounted to the receiver assembly on an underside thereof for supporting a magazine and operative for aligning the magazine with the receiver assembly for feeding ammunition into the receiver assembly when the foldable gun is unfolded to an open and operative configuration for firing the ammunition, and for supporting the magazine in a position generally parallel to and adjacent a receiver assembly underside when the foldable gun is in a folded configuration for storage and carrying; and, stock means pivotally mounted to the receiver assembly for providing a shoulder support for the receiver assembly when the stock means is in an unfolded position and the foldable gun is in an operative configuration for firing ammunition, said stock means being further operative for containing the magazine housing and magazine when the foldable gun is in a folded configuration with the stock means pivoted to a position generally parallel with the receiver assembly and adjacent the receiver assembly underside, said stock means including buffer means for stopping recoil movement of the bolt.

* * * * *